US005474048A

United States Patent [19]

Yamazaki et al.

[11] Patent Number: 5,474,048

[45] Date of Patent: Dec. 12, 1995

[54] EVAPORATIVE FUEL-PROCESSING SYSTEM FOR INTERNAL COMBUSTION ENGINES

[75] Inventors: Kazumi Yamazaki; Teruo Wakashiro; Kouichi Hidano; Takeshi Hara; Takeaki Nakajima, all of Wako; Tomoyuki Kawakami, Tochigi, all of Japan

[73] Assignee: Honda Giken Kogyo Kabushiki Kaisha, Tokyo, Japan

[21] Appl. No.: 362,940

[22] Filed: Dec. 23, 1994

[30] Foreign Application Priority Data

Dec. 24, 1993 [JP] Japan ..... 5-348279

[51] Int. Cl.[6] ..... F02M 25/08

[52] U.S. Cl. ..... 123/519; 137/587; 220/86.2

[58] Field of Search ..... 123/516, 518, 123/519; 220/86.2, DIG. 33; 137/587, 588

[56] References Cited

U.S. PATENT DOCUMENTS

| | | | |
|---|---|---|---|
| 4,714,172 | 12/1987 | Morris | 220/86.2 |
| 4,715,509 | 12/1987 | Ito et al. | 220/86.2 |
| 4,790,283 | 12/1988 | Uranishi et al. | 123/519 |
| 4,917,157 | 4/1990 | Gifford et al. | 123/519 |
| 5,029,722 | 7/1991 | Bollinger et al. | 220/86.2 |
| 5,054,528 | 10/1991 | Saitoh | 137/587 |
| 5,056,570 | 10/1991 | Harris et al. | 220/86.2 |
| 5,099,880 | 3/1992 | Szlaga et al. | 123/519 |
| 5,103,877 | 4/1992 | Sherwood et al. | 123/519 |
| 5,183,087 | 2/1993 | Aubel et al. | 123/518 |
| 5,209,210 | 5/1993 | Ikeda et al. | 123/516 |
| 5,215,132 | 6/1993 | Kobayashi | 123/518 |
| 5,282,497 | 2/1994 | Allison | 137/588 |

*Primary Examiner*—Thomas N. Moulis

*Attorney, Agent, or Firm*—Nikaido, Marmelstein, Murray & Oram

[57] ABSTRACT

An evaporative fuel-processing system for an internal combustion engine includes a canister accommodating an adsorbent therein, for adsorbing evaporative fuel generated in a fuel tank of the engine, and a charging passage connecting between the canister and the fuel tank. A shutter valve is arranged in a fuel supply pipe of the fuel tank in the vicinity of an inlet end thereof, for isolating the interior of the fuel supply pipe from the atmosphere, and the shutter valve is disposed to be opened by the tip of a refueling gun when the latter is inserted into the fuel supply pipe. A pressure-intake port section is arranged in the fuel supply pipe at a side of the shutter valve closer to the main body of the fuel tank, for taking in pressure within the fuel supply pipe. A diaphragm valve is arranged in the charging passage, which has a casing, a diaphragm defining the interior of the casing into a first chamber and a second chamber, a valve element displaceable together with the diaphragm, an evaporative fuel outlet disposed to be opened and closed by the valve element, and a spring urging the valve element in a direction of closing the evaporative fuel outlet. The first chamber communicates with the pressure-intake port section, and the second chamber communicates with the interior of the fuel tank.

8 Claims, 6 Drawing Sheets

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, which prevents emission of evaporative fuel generated in a fuel tank of the engine, into the atmosphere during refueling.

2. Prior Art

FIG. 1 shows a conventional evaporative fuel-processing system for internal combustion engines, which is known from U.S. Pat. No. 4,714,172. In the figure, a fuel tank 101 communicates through a filler tube (fuel supply pipe) 102, a diaphragm valve 107 and a passage 112 with a canister 114 accommodating an adsorbent therein. The diaphragm valve 107 has a first chamber 107*a* and a second chamber 107*b* defined by a diaphragm 108. The first chamber 107*a* communicates through a passage 106 with an upper end of the filler tube 102, while the second chamber 107*b* always communicates with a passage 111 and can communicate with the passage 112 when the valve is opened. A valve element 109 is mounted on the diaphragm 108, for closing and opening the passage 112. A spring 110 is arranged in the first chamber 107*a*, for biasing the diaphragm 108 in a direction of closing the valve.

Mounted in the filler tube 102 at a location between open ends of the passages 106 and 111 opening into the tube 102 is a shutter valve 103 having a valve element formed with a small hole, not shown. The fuel tank 101 and the canister 114 are connected to an intake passage of the engine, not shown.

With the above arrangement, when the upper end of the filler tube 102 is closed by a fuel cap 104, pressure within the first chamber 107*a* and pressure within the second chamber 107*b* are equal to each other, whereby the diaphragm valve 107 is kept in a closed position. On the other hand, when the cap 104 is removed at refueling, the pressure within the first chamber 107*a* lowers to the atmospheric pressure, and hence the diaphragm 108 and the valve element 109 of the diaphragm valve 107 are displaced leftward as viewed in the figure, to open the valve 107, whereby evaporative fuel generated in the fuel tank 101 is introduced into the canister 114.

According to the above conventional system, however, if the fuel cap 104 is inadvertently not tightened after completion of refueling, the following inconvenience arises: That is, when the temperature of fuel elevates so that evaporative fuel is generated in large amounts, evaporative fuel is unfavorably discharged through the small hole, not shown, of the shutter valve 103 to the atmosphere.

SUMMARY OF THE INVENTION

It is the object of the invention to provide an evaporative fuel-processing system for internal combustion engines, which is capable of positively preventing emission of evaporative fuel into the atmosphere even when the fuel cap is inadvertently not tightened.

To attain the above object, the present invention provides An evaporative fuel-processing system for an internal combustion engine including a fuel tank having a main body, and a fuel supply pipe extending from an interior of the main body and having an inlet end, comprising:

a canister accommodating an adsorbent therein, for adsorbing evaporative fuel generated in the fuel tank;

a charging passage connecting between the canister and the fuel tank;

shutter valve means arranged in the fuel supply pipe in the vicinity of the inlet end thereof, for isolating an interior of the fuel supply pipe from the atmosphere, the shutter valve means being disposed to be opened by a tip of a refueling gun when the refueling gun is inserted into the fuel supply pipe;

pressure-intake port means arranged in the fuel supply pipe at a side of the shutter valve means closer to the main body of the fuel tank, for taking in pressure within the fuel supply pipe; and diaphragm valve means arranged in the charging passage, the diaphragm valve means having a casing, a diaphragm defining an interior of the casing into a first chamber and a second chamber, a valve element displaceable together with the diaphragm, an evaporative fuel outlet disposed to be opened and closed by the valve element for communication with and disconnection from an interior of the canister, and means urging the valve element in a direction of closing the evaporative fuel outlet, the first chamber communicating with the pressure-intake port means, the second chamber communicating with an interior of the fuel tank.

Preferably, the pressure-intake port means is arranged at such a location in the fuel supply pipe that it is located in the vicinity of the tip of the refueling gun when the refueling gun is inserted into the fuel supply pipe.

Also preferably, the pressure-intake port means includes negative pressure-generating means for generating negative pressure for placing the first chamber under negative pressure when the refueling gun is inserted for refueling.

Advantageously, the evaporative fuel-processing system includes isolating means for isolating the interior of the fuel tank from the interior of the fuel supply pipe at refueling.

Preferably, the isolating means isolates the interior of the fuel tank from the interior of the fuel supply pipe by liquid fuel.

Also advantageously, the evaporative fuel-processing system includes a second charging passage connecting between the fuel tank and the canister, the second charging passage including valve means for opening the second charging passage when pressure within the fuel tank exceeds atmospheric pressure by a predetermined amount or more.

In an embodiment of the invention, the negative pressure-generating means comprises restriction means, the pressure-intake port means being arranged at such a location in the fuel supply pipe that it is located at a side of the tip of the refueling gun closer to the inlet end of the fuel supply pipe when the refueling gun is inserted into the fuel supply pipe.

In another embodiment of the invention, the negative pressure-generating means comprises venturi means, the pressure-intake port means being arranged at such a location in the fuel supply pipe that it is located at a side of the tip of the refueling gun closer to the main body of the fuel tank when the refueling gun is inserted into the fuel supply pipe.

The above and other objects, features, and advantages of the invention will be more apparent from the following detailed description taken in conjunction with the accompanying drawings.

DETAILED DESCRIPTION

The invention will now be described in detail with reference to the drawings showing embodiments thereof.

Figure 1:
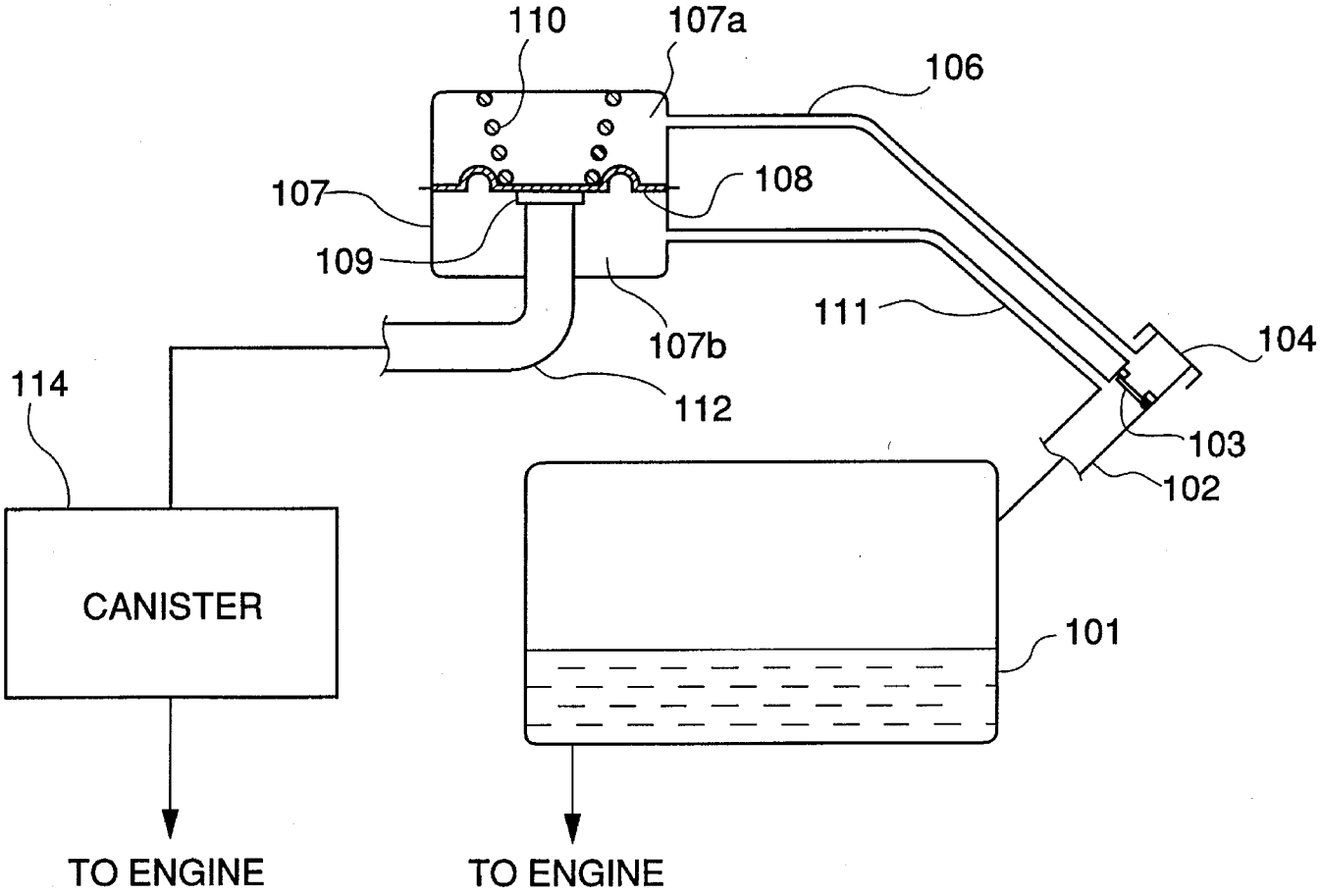
FIG.1 PRIOR ART
FIG. 1 is a schematic diagram showing the arrangement of a conventional evaporative fuel-processing system.
Figure 2:
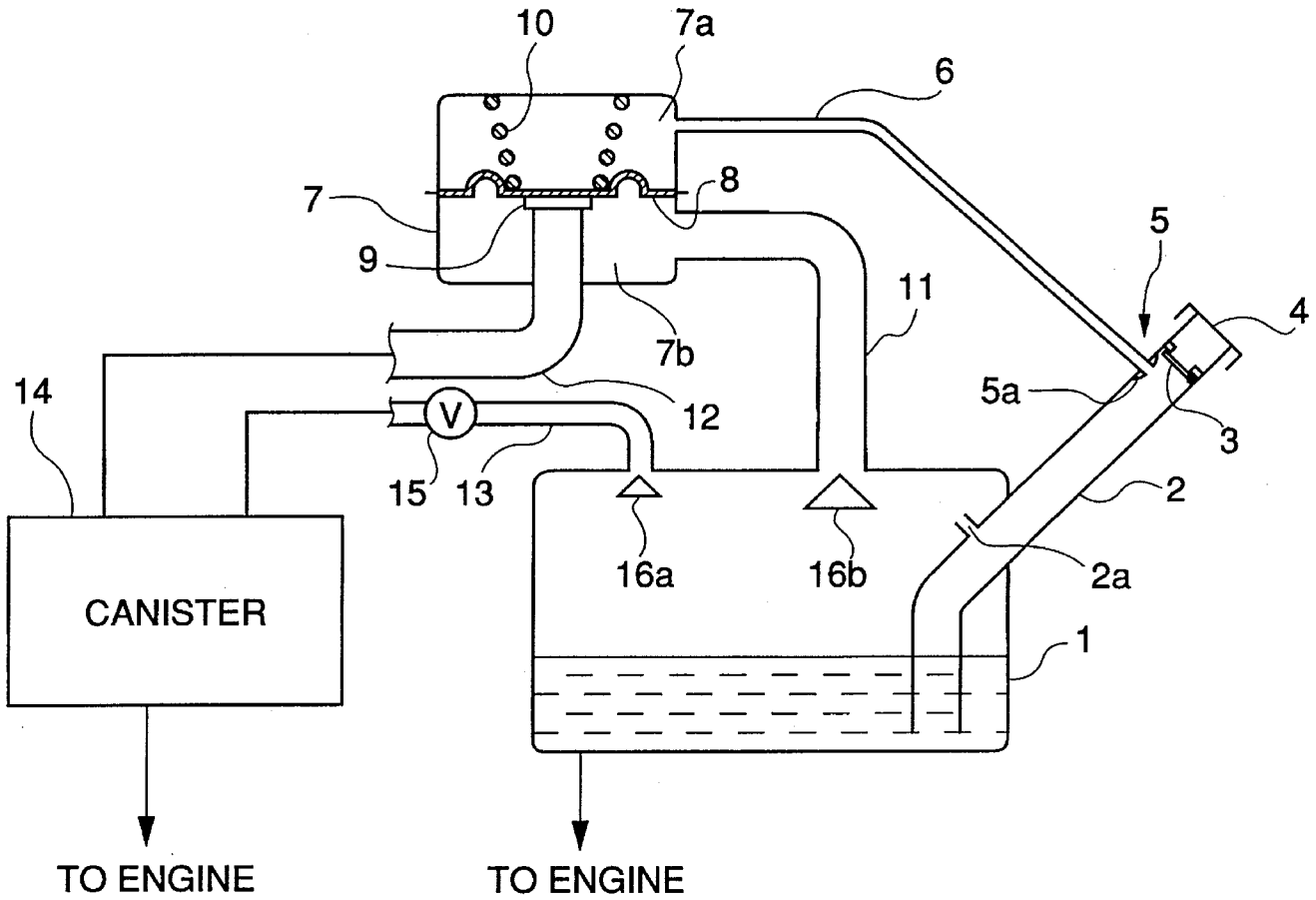
FIG. 2 is a schematic diagram showing the arrangement of an evaporative fuel-processing system according to an embodiment of the invention, in which a filler cap is shown to be mounted in a filler tube.
Figure 3:
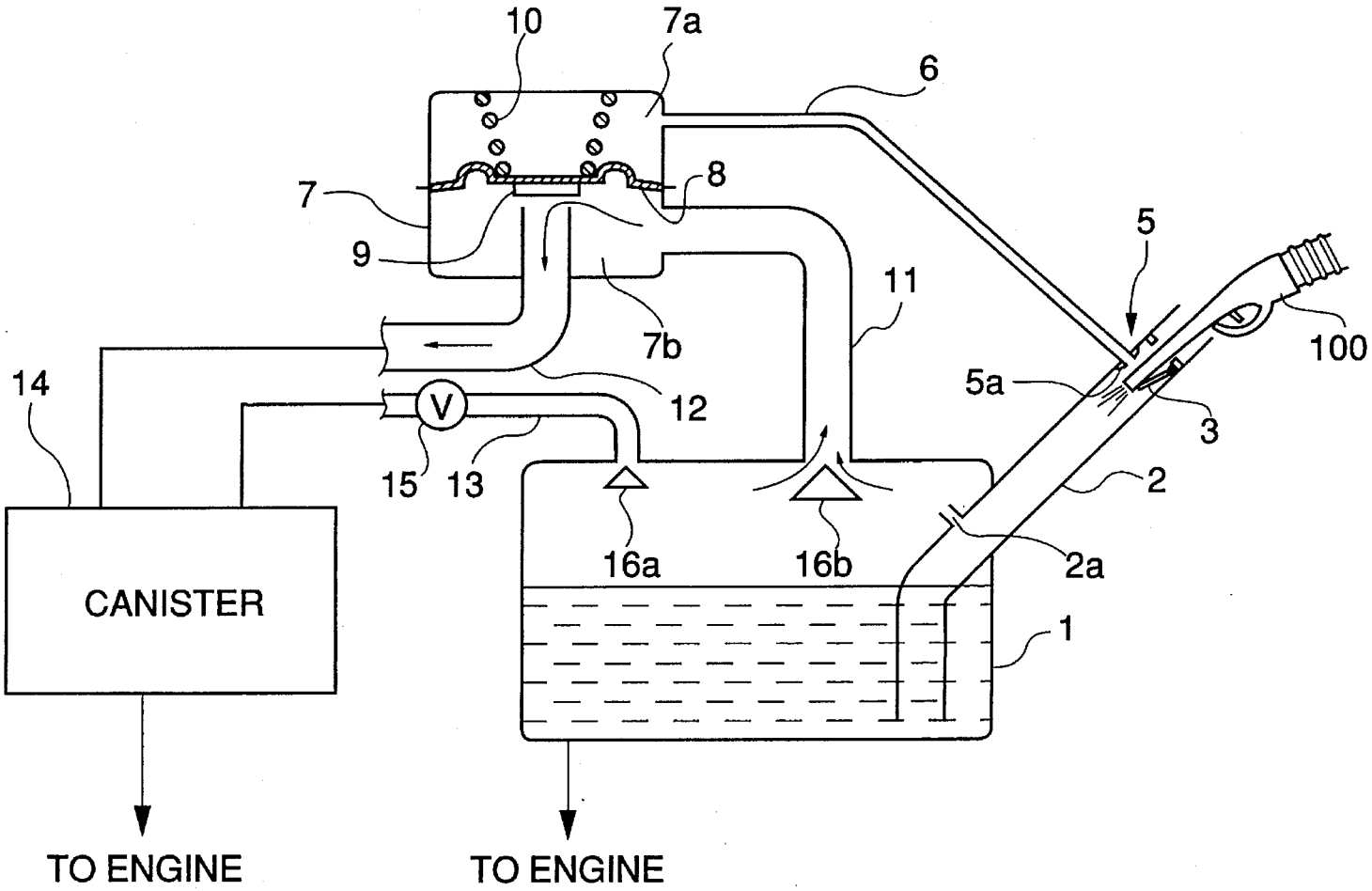
FIG. 3 is a schematic diagram showing the arrangement of the evaporative fuel-processing system of FIG. 2, in which a refueling gun is inserted into the filler tube at refueling.

Referring first to FIG. 2, there is illustrated the whole arrangement of an evaporative fuel-processing system for internal combustion engines, according to an embodiment of the invention. In the figure, reference numeral 1 designates a fuel tank having a filler tube (fuel supply pipe) 2. The filler tube 2 extends to a location proximate to a bottom of the fuel tank 1. Mounted in the filler tube 2 at an upper portion thereof or in the vicinity of an inlet end thereof is a shutter valve 3 which is disposed to be displaced by a tip of a refueling gun 100 to open the filler tube 2 when the refueling gun 100 is inserted into the tube as shown in FIG. 3. The filler tube 2 has a pressure-intake port section port 5 including a restriction member (negative pressure-generating means) 5*a* provided at a location downstream of the shutter valve 3, i.e. on a side of the valve 3 closer to the main body of the fuel tank 1. In the present embodiment, the pressure-intake port section 5 is arranged at a location upstream of a location where a nozzle tip of the refueling gun 100 reaches when the refueling gun 100 is inserted into the filler tube 2. Further, the filler tube 2 has an opening (pressure-introducing means) 2*a* opening into the interior of the fuel tank 1. The opening 2*a* serves to normally keep the pressure within the fuel tank 1 equal to the pressure within the filler tube 2. The opening 2*a* is formed by a hollow projection from an outer peripheral surface of the filler tube 2 located in an upper space within the fuel tank 1. The cross sectional area of the opening 2*a* is set so small that the amount of evaporative fuel draining through the opening 2*a* at refueling can be kept at the minimum desired value. An upper end of the filler tube 2 is normally covered with a fuel cap 4.

A diaphragm valve 7 has a first chamber 7*a* and a second chamber 7*b* defined by a diaphragm 8. The first chamber 7*a* communicates through a passage 6 with the pressure-intake port section 5, while the second chamber 7*b* communicates through a passage (charging passage) 11 with an upper space within the fuel tank 1. Further, the second chamber 7*b* can communicate through a passage (charging passage) 12 with a canister 14 when the diaphragm valve 7 is open. A valve element 9 is mounted on the diaphragm 8 for displacement in unison therewith to open and close an associated end of the passage 12. A spring 10 is arranged in the first chamber 7*a*, for biasing the diaphragm 8 in a direction of closing the valve.

The fuel tank 1 is connected to the canister 14 through a passage 13 across which is arranged a two-way valve 15, which opens when the pressure within the fuel tank 1 is higher than the atmospheric pressure by a predetermined amount or more. The fuel tank 1 and the canister 14 are connected to the engine, not shown, through a purging passage, not shown. The canister 14 accommodates therein an adsorbent which adsorbs evaporative fuel generated in and supplied from the fuel tank 1, wherefrom adsorbed evaporative fuel is suitably purged to an intake system, not shown, of the engine.

In FIG. 2, reference numerals 16*a* and 16*b* schematically represent float needle valves for blocking associated open ends of the passage 11 and the passage 13 in the event of overturning or the like of a vehicle in which the engine is installed, to thereby prevent evaporative fuel in the fuel tank 1 from flowing into the canister 14.

Figure 4A:
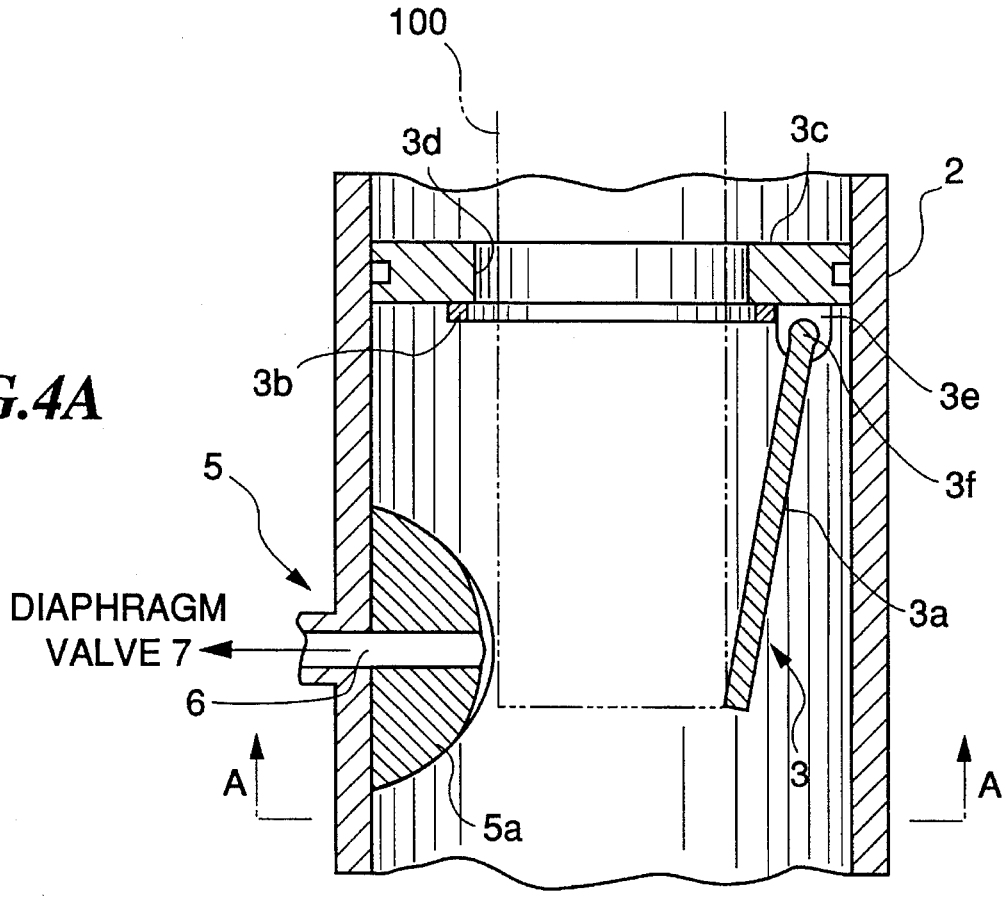
FIG. 4A is a fragmentary longitudinal sectional view showing in detail the filler tube of the evaporative fuel-processing system in the position of FIG. 3.
Figure 4B:
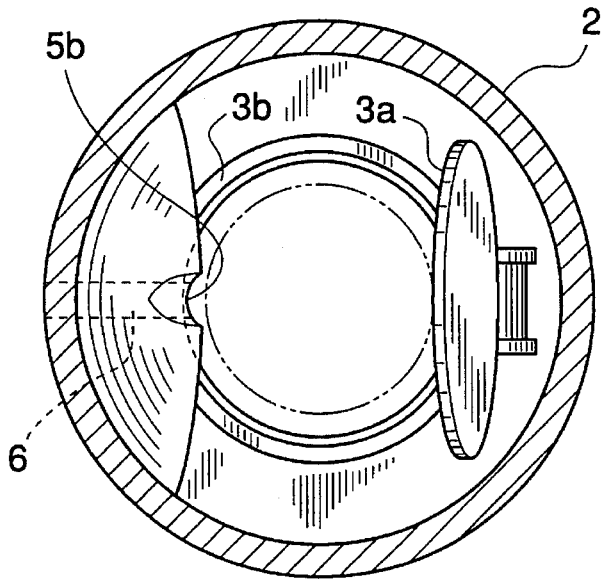
FIG. 4B is a transverse sectional view taken along line A—A in FIG. 4A.

FIG. 4A shows details of the upper portion of the filler tube 2, and FIG. 4B shows a transverse section of the same portion taken along line A—A in FIG. 4A.

As shown in these figures, the shutter valve 3 is comprised of a valve element 3*a*, an annular sealing member 3*b*, a support member 3*c* with a valve hole 3*d* formed therein, a bracket 3*e*, and a valve stem 3*f*. The support member 3*c* is fixed to an inner peripheral surface of the filler tube 2. The bracket 3*e* is secured to a lower side surface of an outer periphery of the support member 3*c*, to which is pivoted the valve element 3*a* by the valve stem 3*f*, for opening and closing the valve hole 3*d*. Wound around the valve stem 3*f* is a return spring, not shown, which is disposed to bias the valve element 3*a* to a valve closing position when the refueling gun 100 is not inserted into the filler tube 2.

The annular sealing member 3*b* is attached to the lower side surface of the support member 3*c* in concentricity with the valve hole 3*d*, for sealing the pressure on a downstream side of the shutter valve 3 against the atmospheric pressure on an upstream side thereof when the valve 3 is in a closed position.

Further, the restriction member 5*a* is provided with a recess 5*b* having a concave section for preventing the open end of the passage 6 from being blocked by the refueling gun 100 when it is inserted into the filler tube 2. The recess 5*b* extends longitudinally of the filler tube 2 and has a bottom surface thereof in which the open end of the passage 6 opens.

The operation of the evaporative fuel-processing system constructed as above according to the present embodiment will be described hereinbelow.

On an occasion other than refueling (at non-refueling), as shown in FIG. 2, the shutter valve 3 is closed, and consequently the fuel tank 1, the filler tube 2, and the first and second chambers 7*a* and 7*b* of the diaphragm valve 7 are placed under almost equal pressure, whereby the diaphragm valve 7 is kept closed by an urging force of the spring 10. Further, even if the fuel cap 4 is inadvertently not tightened, due to the closure of the shutter valve 3, evaporative fuel does not leak from an oil-filling end or outer end of the filler tube 2, nor the diaphragm valve 7 is opened to allow evaporative fuel to leak from the canister 14.

On the other hand, at refueling, as shown in FIG. 3, when the refueling gun 100 is inserted into the filler tube 2, the shutter valve 3 is opened, whereby the pressure in the vicinity of the pressure-intake port section 5 in the filler tube 2 is reduced to the atmospheric pressure. Further, supply of fuel into the fuel tank 1 raises the pressure within the second chamber 7*b* of the diaphragm valve 7 above the pressure within first chamber 7*a*, so that the diaphragm 8 and the valve element 9 are displaced upward as viewed in FIG. 3, to thereby open the diaphragm valve 7. As a result, a large amount of evaporative fuel generated in the fuel tank 1 is supplied through the passage 11, the second chamber 7*b*, and the passage 12 to the canister 14.

On this occasion, charging of fuel into the fuel tank 1 causes an air flow in the vicinity of the restriction member 5*a* to further lower the pressure in the vicinity of the pressure-intake port section 5. Consequently, the pressure within the first chamber 7*a* of the diaphragm 7 is further lowered, to thereby ensure positive opening of the valve 7. Therefore, the load of the spring 10 can be set to such a large value as enables the diaphragm valve 7 to be positively opened at refueling and positively kept closed at non-refueling even if a spring with a high degree of set load accuracy is not employed.

Further, according to the present embodiment, since the filler tube 2 extends to a location proximate to or nearly as deep as the bottom of the fuel tank 1, an upper space within the fuel tank 1 is isolated from the fuller tube 2, whereby evaporative fuel generated within the fuel tank 1 can be prevented from emitting to the outside through the filler tube 2.

Besides, by virtue of the provision of the opening 2*a*, the pressure within the filler tube 2 is normally made equal to the pressure within the fuel tank 1, to thereby more positively prevent the diaphragm valve 7 from opening at non-refueling. The diameter of the opening 2*a* should be set to such a small value that emission of evaporative fuel to the outside is minimized at refueling.

Figure 5:
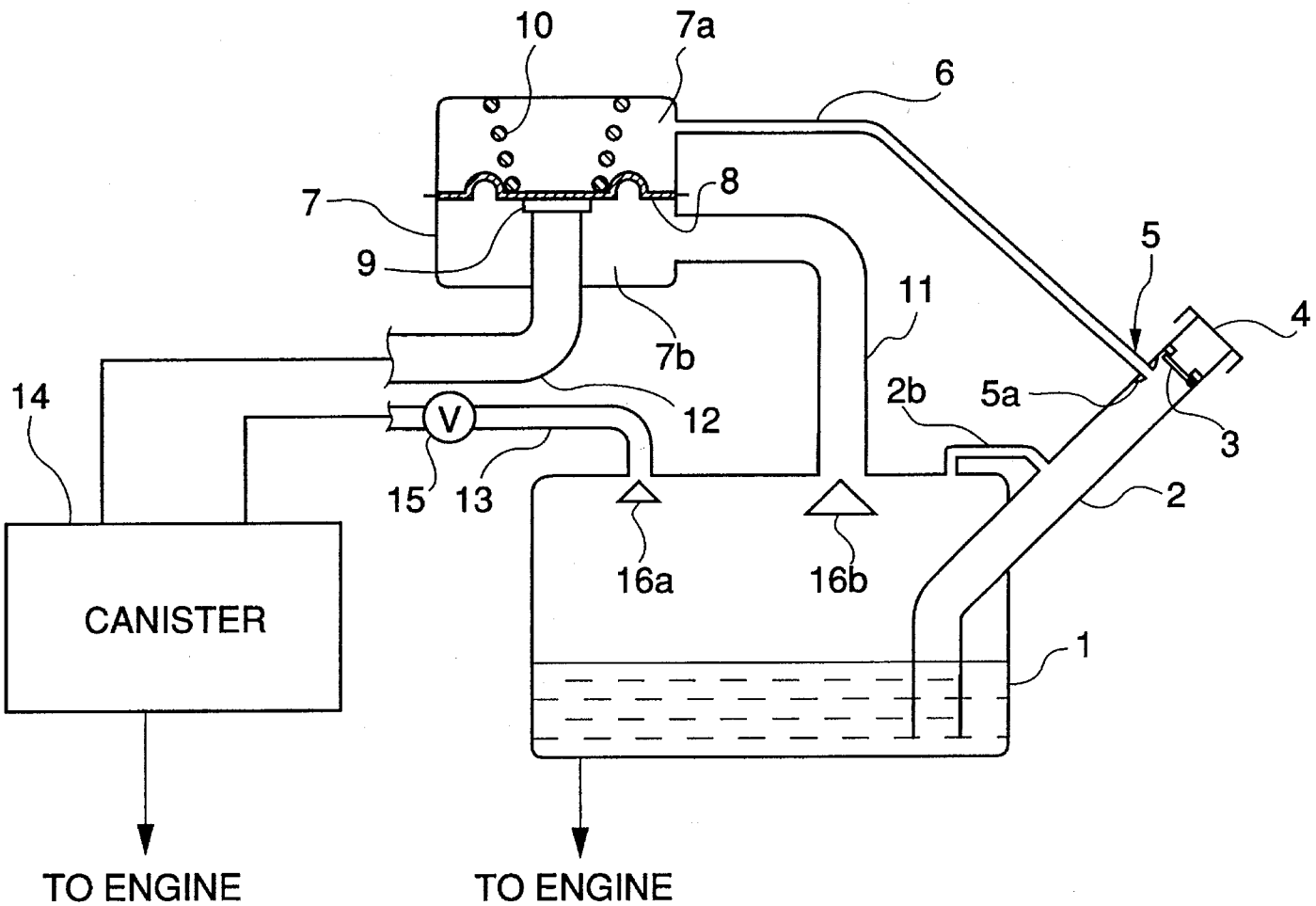
FIG. 5 is a schematic diagram showing a variation of the embodiment shown in FIG. 2.

FIG. 5 shows a variation of the above described embodiment of the invention. In this variation, as the pressure-introducing means, the opening 2*a* is replaced by a communication pipe 2*b*. The communication pipe 2*b* extends between an outer peripheral wall of the filler tube 2 outside the fuel tank 1 and a ceiling wall of the fuel tank 1 and communicates between the filler tube 2 and the fuel tank 1. According to the variation as well, the pressure within the filler tube 2 is normally made equal to the pressure within the fuel tank 1.

Figure 6:
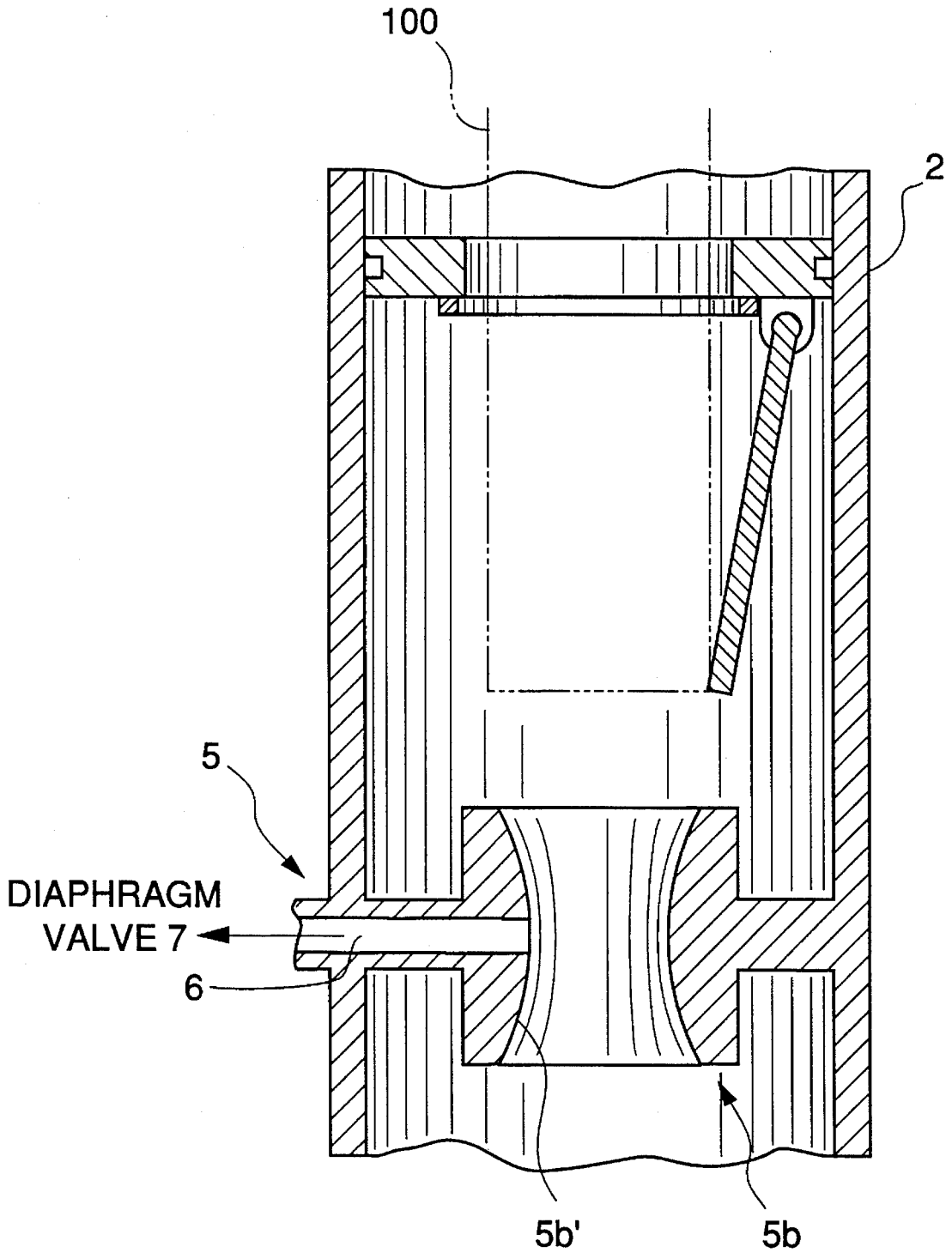
FIG. 6 is a fragmentary longitudinal sectional view similar to FIG. 4A, showing another variation of the embodiment shown in FIG. 2.

FIG. 6 shows another variation of the first embodiment, wherein the pressure-intake port section 5 is modified. According to the present variation, a venturi tube (negative pressure-generating means) 5*b* is provided at a location downstream of a location which is reached by the tip of the refueling gun 100 when inserted. The passage 6 opens into a central hole of the venturi tube 5*b*. By virtue of this construction, negative pressure is generated within the passage 6, due to a flow of supply fuel, which further lowers the pressure at the pressure-intake port section 5.

What is claimed is:

1. An evaporative fuel-processing system for an internal combustion engine including a fuel tank having a main body, and a fuel supply pipe extending from an interior of said main body and having an inlet end, comprising:

a canister accommodating an adsorbent therein, for adsorbing evaporative fuel generated in said fuel tank;

a charging passage connecting between said canister and said fuel tank;

shutter valve means arranged in said fuel supply pipe in the vicinity of said inlet end thereof, for isolating an interior of said fuel supply pipe from the atmosphere, said shutter valve means being disposed to be opened by a tip of a refueling gun when said refueling gun is inserted into said fuel supply pipe;

pressure-intake port means arranged in said fuel supply pipe at a side of said shutter valve means closer to said main body of said fuel tank, for taking in pressure within said fuel supply pipe; and diaphragm valve means arranged in said charging passage, said diaphragm valve means having a casing, a diaphragm defining an interior of said casing into a first chamber and a second chamber, a valve element displaceable together with said diaphragm, an evaporative fuel outlet disposed to be opened and closed by said valve element for communication with and disconnection from an interior of said canister, and means urging said valve element in a direction of closing said evaporative fuel outlet, said first chamber communicating with said pressure-intake port means, said second chamber communicating with an interior of said fuel tank.

2. An evaporative fuel-processing system as claimed in claim 1, wherein said pressure-intake port means is arranged at such a location in said fuel supply pipe that it is located in the vicinity of said tip of said refueling gun when said refueling gun is inserted into said fuel supply pipe.

3. An evaporative fuel-processing system as claimed in claim 1, wherein said pressure-intake port means includes negative pressure-generating means for generating negative pressure for placing said first chamber under negative pressure when said refueling gun is inserted for refueling.

4. An evaporative fuel-processing system as claimed in claim 1, including isolating means for isolating said interior of said fuel tank from said interior of said fuel supply pipe at refueling.

5. An evaporative fuel-processing system as claimed in claim 4, wherein said isolating means isolates said interior of said fuel tank from said interior of said fuel supply pipe by liquid fuel.

6. An evaporative fuel-processing system as claimed in claim 1, further including a second charging passage connecting between said fuel tank and said canister, said second charging passage including valve means for opening said second charging passage when pressure within said fuel tank exceeds atmospheric pressure by a predetermined amount or more.

7. An evaporative fuel-processing system as claimed in claim 3, wherein said negative pressure-generating means comprises restriction means, said pressure-intake port means being arranged at such a location in said fuel supply pipe that it is located at a side of said tip of said refueling gun closer to said inlet end of said fuel supply pipe when said refueling gun is inserted into said fuel supply pipe.

8. An evaporative fuel-processing system as claimed in claim 3, wherein said negative pressure-generating means comprises venturi means, said pressure-intake port means being arranged at such a location in said fuel supply pipe that it is located at a side of said tip of said refueling gun closer to said main body of said fuel tank when said refueling gun is inserted into said fuel supply pipe.

* * * * *